US010011968B2

(12) United States Patent
Rabaron et al.

(10) Patent No.: US 10,011,968 B2
(45) Date of Patent: Jul. 3, 2018

(54) GRAVITY STRUCTURE INTENDED FOR A MARINE CIVIL-ENGINEERING CONSTRUCTION AND ASSOCIATED MANUFACTURING METHOD

(71) Applicant: SOLETANCHE FREYSSINET, Rueil Malmaison (FR)

(72) Inventors: Vincent Rabaron, Paris (FR); Etienne Combescure, Rueil Malmaison (KR); Michel Coudry, Rueil Malmaison (KR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 15/054,867

(22) Filed: Feb. 26, 2016

(65) Prior Publication Data

US 2016/0251815 A1 Sep. 1, 2016

(30) Foreign Application Priority Data

Feb. 27, 2015 (FR) ..... 15 51689

(51) Int. Cl.

| | |
|---|---|
| ***E02B 17/02*** | (2006.01) |
| ***E02D 7/22*** | (2006.01) |
| ***E02D 27/10*** | (2006.01) |
| ***E02D 27/50*** | (2006.01) |
| ***E02D 27/52*** | (2006.01) |
| *E02B 17/00* | (2006.01) |

(52) U.S. Cl.

CPC ..... *E02B 17/02* (2013.01); *E02B 17/025* (2013.01); *E02D 7/22* (2013.01); *E02D 27/10* (2013.01); *E02D 27/50* (2013.01); *E02D 27/525* (2013.01); *E02B 2017/0039* (2013.01); *E02B 2017/0056* (2013.01); *E02B 2017/0069* (2013.01); *E02B 2017/0091* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,488,967 A * | 1/1970 | Toossi | E02B 17/027 114/121 |
| 4,696,601 A * | 9/1987 | Davenport | B63B 21/502 405/202 |
| 4,968,180 A * | 11/1990 | Danguy des Deserts | B63B 35/4406 405/202 |
| 2013/0084136 A1 | 4/2013 | Losnedal et al. | |

FOREIGN PATENT DOCUMENTS

| | | | |
|---|---|---|---|
| FR | 2 645 827 A1 | 10/1990 | |
| GB | 1383819 A * | 2/1974 | E02B 17/027 |

* cited by examiner

*Primary Examiner* — Kyle Armstrong
(74) *Attorney, Agent, or Firm* — Dentons US LLP

(57) ABSTRACT

The subject matter of the invention is a gravity structure intended for a marine civil-engineering construction, comprising a slab configured so as to be placed on a sea bed and secured to a shaft directed in a principal direction substantially orthogonal to said slab, characterized in that the gravity structure comprises at least one anchoring tie rod extending in said shaft and in the slab, the gravity structure being configured so that, in a service position of the gravity structure, said at least one anchoring tie rod is anchored in the sea bed.

10 Claims, 3 Drawing Sheets

GRAVITY STRUCTURE INTENDED FOR A MARINE CIVIL-ENGINEERING CONSTRUCTION AND ASSOCIATED MANUFACTURING METHOD

This application claims priority to French Application No. 15 51689 filed Feb. 27, 2015 in the French Patent Office, and is hereby incorporated by reference for all purposes as if fully set forth herein in its entirety.

The subject matter of the invention is a gravity structure intended for a marine civil-engineering construction and an associated manufacturing method.

A known gravity structure comprises a slab configured so as to be placed on a sea bed and secured to a shaft directed in a principal direction substantially orthogonal to the slab.

The marine civil-engineering construction for which such a gravity structure is intended is for example an offshore wind turbine or a bridge.

In the service position, that is to say when the gravity structure is resting on the sea bed, the shaft is disposed substantially vertically and is surmounted by a mast, itself provided with a nacelle and blades when the marine construction is a turbine, surmounted by a pile and a deck when the construction is a bridge.

Given the mechanical constraints, in particular due to wind and swell, exerted on the gravity structure, as well as its dimensions, it is essential to ensure the stability of the gravity structure in the service position.

To do this, it is necessary to prepare the sea bed before the installation of the gravity structure by preliminary dredging, followed by the placing of a levelling layer and an optional anti-erosion protective layer.

However, the slab, provided in the form of a cylinder, must have a very wide diameter, around a few tens of meters, which means that the area of the sea bed to be prepared is itself very wide.

Because of the large dimensions of the structure, and in particular the dimensions of the slab, it is also necessary to provide large quantities of concrete and steel, material from which the gravity structure is generally formed.

The large dimensions of the gravity structure also means that the method for installation at sea, in the service position, of the gravity structure is lengthy and complex to implement.

In addition, it is necessary to fill the shaft with ballast in order to complete the installation of the gravity structure, an operation that proves all the more expensive since the material, for example ballast sand, must be conveyed from a port or a dredging area.

The aim of the invention is to at least partially remedy these drawbacks.

To this end, the subject matter of the invention is a gravity structure intended for a marine civil-engineering construction, comprising a slab configured so as to be placed on a sea bed and secured to a shaft directed in a principal direction substantially orthogonal to said slab, characterized in that the gravity structure comprises at least one anchoring tie rod extending in said shaft and in the slab, the gravity structure being configured so that, in a service position of the gravity structure, said at least one anchoring tie rod is anchored in said sea bed.

By means of the gravity structure according to the invention, the stability of the gravity structure is partly assured by said at least one anchoring tie rod.

Thus the dimensions of the gravity structure, and in particular the diameter of the slab, may be reduced, for example by 20% to 30% compared with the prior art, resulting in a reduction in the quantities of concrete and steel necessary for manufacturing the gravity structure, and likewise a reduction in the size of the area of the sea bed to be prepared before the gravity structure is installed in the service position.

Another result is that the gravity structure is less heavy than in the prior art, and can therefore be more easily transported and then installed, for example by means of a heavy-lift vessel, which is not possible for a heavier structure of the prior art without its being necessary to mobilize a vessel of exceptional capacity.

In addition, the reduced dimensions of the gravity structure guarantee that the forces exerted on the gravity structure by swell are smaller.

Another advantage of the invention lies in the fact that the anchoring tie rod or rods vertically prestress the shaft of the gravity structure, which firstly improves the stability of the gravity structure and secondly possibly reduces the number of other prestressing devices to be provided for the shaft.

An additional advantage is that, because of the reduced dimensions and weight of the gravity structure according to the invention, filling the shaft with water suffices to provide the stability of the gravity structure on the sea bed. Thus the method for manufacturing the gravity structure according to the invention dispenses with the transportation and filling of the ballast material that is necessary for the gravity structure according to the prior art, as already mentioned.

Moreover, the maintenance and inspection of the anchoring tie rod or rods are simple to implement. It is for example possible to check and if necessary adjust the residual tension of each tie rod by a known weighing technique (or "lift-off test").

According to another feature of the invention, the shaft comprises an end opposite to the slab, and said at least one anchoring tie rod extends from the end opposite to the slab in the shaft.

According to another feature of the invention, the gravity structure comprises at least one tube for guiding said at least one anchoring tie rod extending from the end opposite to the slab as far as into the slab.

According to another feature of the invention, the shaft is hollow and comprises a column and a conical base.

According to another feature of the invention, each guide tube is disposed in a longitudinal wall of the mast and in the open air in the conical base.

According to another feature of the invention, the gravity structure comprises a removable platform.

According to another feature of the invention, the gravity structure comprises at least two anchoring tie rods.

Another subject matter of the invention is a method for manufacturing a gravity structure intended for a marine civil-engineering construction, using a slab configured so as to be placed on a sea bed and secured to a shaft directed in a principal direction substantially orthogonal to said slab, the manufacturing method comprising a step of placing at least one anchoring tie rod so that said at least one tie rod extends in the shaft and in the slab, the gravity structure being configured so that, in a service position, the anchoring tie rod is anchored in the sea bed.

According to another feature of the invention, the step of placing at least one anchoring tie rod is preceded by a step of placing at least one tube for guiding said at least one anchoring tie rod extending from an end of the shaft opposite to the slab, as far as the slab.

According to another feature of the invention, the method comprises a step prior to the steps of placing the tie rod, comprising a step of installing the gravity structure on a sea bed, the shaft being erected in a vertical position.

According to another feature of the invention, the method comprises a step of filling with water an immersed internal part of the gravity structure.

According to another feature of the invention, the step of placing said at least one anchoring tie rod comprises a step of installing the removable platform at an end of the shaft opposite to the slab.

According to another feature of the invention, the method comprises a step of drilling by a drilling tool disposed in said at least one guide tube, during which the drilling tool digs a hole in the sea bed, and then the tie rod is introduced into the guide tube and into the drilled hole.

According to another feature of the invention, the step of placing said at least one anchoring tie rod comprises a step of anchoring said at least one anchoring tie rod during which the drilling hole is the subject of an injection of grout.

According to another feature of the invention, the step of placing said at least one anchoring tie rod comprises a step of tensioning said at least one anchoring tie rod made to a higher anchoring.

Other features and advantages of the invention will also emerge from a reading of the following description. The latter is purely illustrative and must be read with regard to the accompanying drawings, in which.

Figure 1:
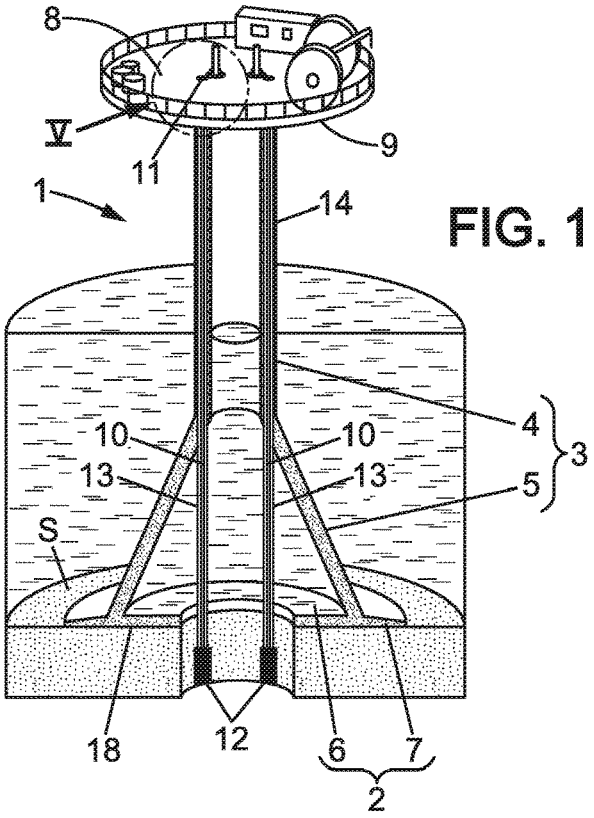
FIG. 1 illustrates a gravity structure according to the present invention.
Figure 4A:
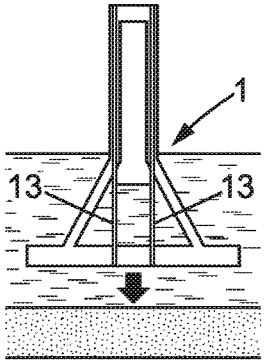
Figure 4B:
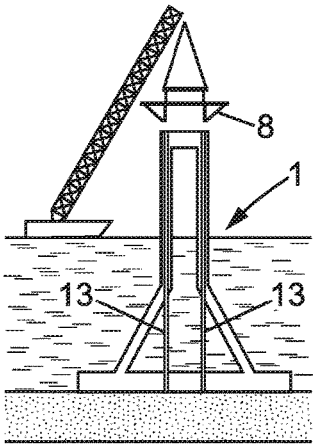
Figure 4C:
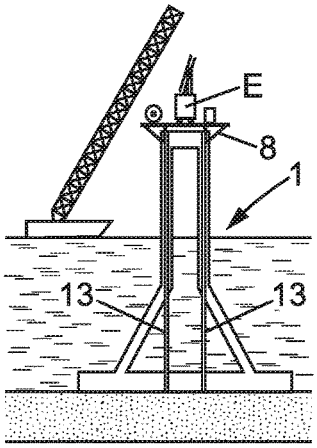
Figure 4D:
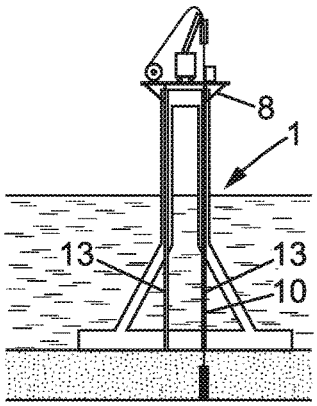
Figure 4E:
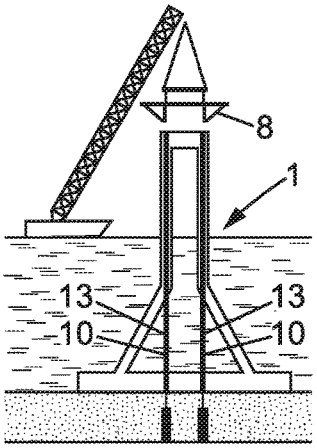
Figure 5:
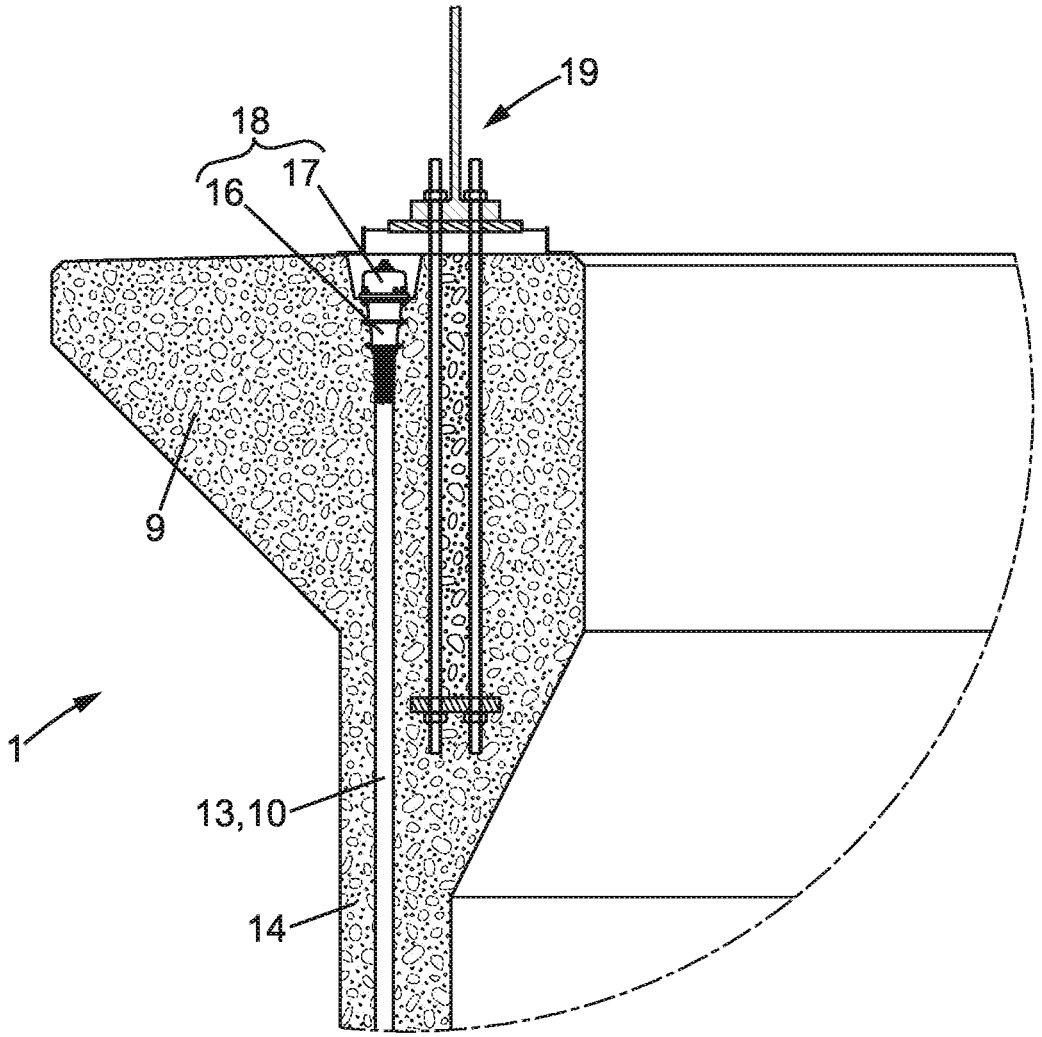

FIGS. 4*a* to 4*e* illustrate a method for manufacturing a gravity structure of FIG. 1; and FIG. 5 is a view in cross section of a detail of FIG. 1.

Gravity Structure

As can be seen in FIG. 1, a gravity structure 1, intended for a marine civil-engineering construction, comprises a slab 2 configured so as to be placed on a sea bed S and secured to a shaft 3 directed in a principal direction substantially orthogonal to the slab 2.

In FIG. 1, the gravity structure 1 is illustrated in a position corresponding to a construction phase before installation of the wind turbine, in which the gravity structure is resting on the sea bed S that has optionally been prepared with a view to the installation of the gravity structure 1 by preliminary operations known to persons skilled in the art.

Once installed, the slab 2 is in contact with the bed S while the shaft 3 is erected vertically.

As can be seen in FIG. 1, the shaft 3 comprises a column 4 forming the top part of the shaft 3 and a base 5 forming the bottom part of the shaft 3.

The column 4 has a roughly tubular shape.

The base 5 has a roughly conical shape that splays from the mast 4 as far as the slab 2.

The column 4 and the base 5 are hollow.

As can be seen in FIG. 1, the base 5 is completely immersed while the column 4 is partially immersed.

The slab 2 comprises a part 6 internal to the base 5 extended by an external part 7.

The slab 2 has a roughly circular shape with a substantially constant thickness under the base 5 and may have a radial slope or camber (bevel) on its external part 7.

The gravity structure 1 is advantageously temporally provided, as will be explained below, with a removable platform 8 disposed at a top end 9 of the column 4.

In other words, the slab 2 constitutes the bottom end of the gravity structure 1 while the platform 8 is disposed at a top end 9 of the gravity structure 1.

The gravity structure 1 comprises at least one anchoring tie rod 10 extending in the shaft 3 and in the slab 2.

In the figures, two anchoring tie rods 10 are shown.

Nevertheless, the invention is not limited to this number, and it can of course be envisaged providing the structure 1 with a single anchoring tie rod or on the contrary providing the structure 1 with a plurality of tie rods distributed over the circumference of the column.

The gravity structure 1 is configured so that each of the anchoring tie rods 10 is anchored in the sea bed S.

As can be seen in FIG. 1, the anchoring tie rods 10 extend from the platform 8 into the shaft 3 and the slab 2.

In other words, one 11 of the ends 11, 12 of the anchoring tie rods 10, otherwise referred to as top and bottom anchorings, is disposed in the top end 9.

As can be seen in FIG. 1, the top anchoring 11 of each tie rod 10 is placed in the immediate vicinity of the top face of the shaft 3.

The other end 12 is disposed in the sea bed S.

Each anchoring tie rod 10 is tensioned between its ends 11, 12, which provides vertical prestressing of the shaft 3.

As can be seen in FIG. 1, the gravity structure 1 comprises two guide tubes 13, each of the tubes 13 being associated with one of the tie rods 10.

In other words, each tie rod 10 extends in a guide tube 13 from the top end 9 into the slab 2.

Advantageously, each guide tube 13 protects the associated anchoring tie rod 10.

As illustrated in FIGS. 1 and 5, each guide tube 13 is disposed in a longitudinal wall 14 of the column 4 and in open air in the conical base 5.

The guide tubes guide the fitting in of the anchoring tie rods 10 as well as the movement of a drill, as will be explained below.

As can be seen more particularly in FIG. 5, an attachment element 15, comprising an anchoring piece 16, for example of the trumpet type, and a cap 17 covering an anchoring block (not shown). The gravity structure 1 also comprises a specific connection device disposed in a surface 18 of the slab 15 forming an interface with the sea bed S.

Figure 2:
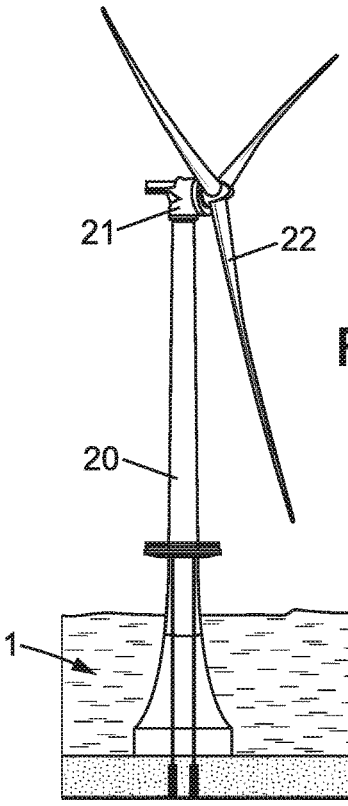
FIG. 2 illustrates the gravity structure of FIG. 1 in an application to an offshore wind turbine.
Figure 3:
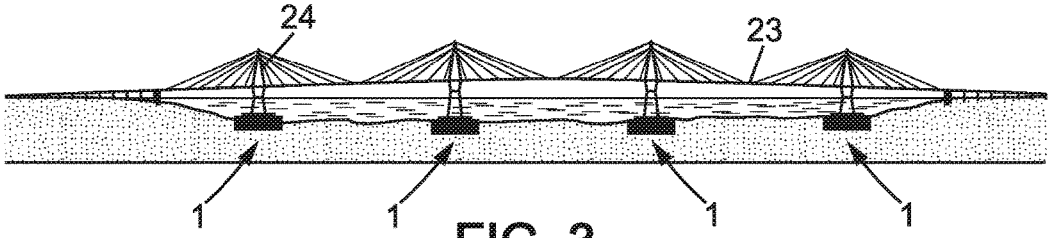
FIG. 3 illustrates the gravity structure of FIG. 1 in an application to a cable-stayed bridge.

The gravity structure 1 is illustrated in an application to an offshore wind turbine in FIG. 2 and in an application to a bridge in FIG. 3.

In the application in FIG. 2, the platform 8 has been removed before anchoring of a mast 20 carrying a nacelle 21 and blades 22 at the head of the column 4.

FIG. 5 illustrates at reference 19 elements for securing the mast 20 to the gravity structure 1.

In the application in FIG. 3, the platforms 8 have been removed before the towers 24 and a deck 23 are erected on the top ends 9 of the gravity structures 1.

Manufacturing Method

As can be seen in FIG. 4*a*, a method for manufacturing the gravity structure 1 comprises a step of installing the substructure comprising the shaft 3 and the slab 2, but not the anchoring tie rods 10.

During this step, the slab 2 is placed on the previously prepared sea bed S while the shaft 3 is erected substantially vertically.

Filling the shaft 3 with water, concomitantly with the placing of the substructure, enables the substructure to be immersed gradually until the slab 2 is in contact with the sea bed S.

Then, as illustrated in FIGS. 4*b* and 4*c*, the manufacturing method comprises a step of installing the platform 8 at the top end 8 of the shaft 3. This step is preferably carried out by a crane ship.

Once the platform 8 is in place, any equipment E necessary for installing the tie rods is brought thereto.

Advantageously, in a prior step, not illustrated, that is to say before the step of installing the slab 2 on the sea bed S, each guide tube is fitted in the shaft 3 when the substructure 1 is constructed, before it is transported to the installation site.

As can be seen in FIG. 4*d*, the manufacturing method next comprises a step of placing each anchoring tie rod 10 in the associated guide tube 13.

To do this, the method comprises a step of drilling with a drilling tool brought into contact with the sea bed S after being moved in each guide tube 13.

During this step, the drilling tool hollows out a hole T in the sea bed S.

Next, the drilling tool is extracted from the guide tube 13; the anchoring tie rod 10 is then introduced into the associated guide tube 13 and then into the drilled hole T.

Preferably, the drilling step comprises a preliminary step of drilling a preliminary hole facilitated by the specific connection device provided at the interface of the slab and sea bed, in accordance with a method known to persons skilled in the art.

Next the method comprises a step of anchoring each anchoring tie rod 10 in the associated drilling hole T by the injection of grout around the anchoring tie rod 10 in the drilling hole T.

The manufacturing method also comprises a tensioning step performed at the top anchoring 11, on the platform 8, advantageously by means of a long-travel jack, because of the great free length of each anchoring tie rod 10.

After installation and tensioning of the anchoring tie rods 10, the platform 8 is demobilised, optionally to another gravity structure, as can be seen in FIG. 4*e*.

As already mentioned, the invention provides a prestressing that can be associated in parallel with prestressing cables equipping the structure 1 and known to persons skilled in the art, at the same time as it allows a reduction in the dimensions and weight of the gravity structure.

What is claimed:

1. A gravity structure intended for a marine civil-engineering construction, comprising: a slab configured so as to be placed on a sea bed and secured to a shaft directed in a principal direction substantially orthogonal to said slab, wherein the gravity structure comprises at least one anchoring tie rod extending in said shaft and in the slab, the gravity structure being configured so that, in a service position of the gravity structure, said at least one anchoring tie rod is anchored in the sea bed, and wherein the shaft comprises an end opposite to the slab, said at least one anchoring tie rod extending from the end opposite to the slab in the shaft, and at least one tube for guiding said at least one anchoring tie rod and extending from the end opposite to the slab into the slab; and wherein the shaft is hollow and comprises a column forming a top part of the shaft and a base forming a bottom part of the shaft, and each guide tube is disposed in a longitudinal wall of the column and in open air in the base.

2. The gravity structure according to claim 1, comprising a removable platform.

3. The gravity structure according to claim 1, comprising a plurality of anchoring tie rods.

4. A method for installing a gravity structure intended for a marine civil-engineering construction, using a slab configured so as to be placed on a sea bed and secured to a shaft directed in a principal direction orthogonal to said slab, the installing method comprising: a step of placing at least one anchoring tie rod so that said at least one tie rod extends in the shaft and in the slab, the gravity structure being configured so that, in a service position, the anchoring tie rod is anchored in the sea bed, the step of placing said at least one anchoring tie rod being preceded by a step of placing at least one tube for guiding said at least one anchoring tie rod extending from an end of the shaft opposite to the slab, as far as the slab; and wherein the shaft is hollow and comprises a column forming a top part of the shaft and a base forming a bottom part of the shaft, and each guide tube is disposed in a longitudinal wall of the column and in open air in the base.

5. The installing method according to claim 4 comprising: a step prior to the steps of placing the tie rod, comprising a step installing the slab on a sea bed, the shaft being erected in a vertical position.

6. The installing method according to claim 4, comprising a step of filling with water an immersed internal part of the gravity structure.

7. The installing method according to claim 4, in which the step of placing said at least one anchoring tie rod comprises a step of installing a removable platform at an end of the shaft opposite to the slab.

8. The installing method according to claim 7, in which the step of placing said at least one anchoring tie rod comprises a step of tensioning said at least one anchoring tie rod performed at a top anchoring.

9. The installing method according to claim 4, comprising a step of drilling with a drilling tool disposed in said at least one guide tube, during which the drilling tool hollows out a hole in the sea bed, and then the tie rod is introduced into the guide tube and into the drilled hole.

10. The installing method according to claim 7, in which the step of placing said at least one anchoring tie rod comprises a step of anchoring said at least one anchoring tie rod during which the drilling hole is the subject of an injection of grout.

* * * * *